US010539374B2

(12) United States Patent
Liu et al.

(10) Patent No.: US 10,539,374 B2
(45) Date of Patent: Jan. 21, 2020

(54) FIN AND BENDING TYPE HEAT EXCHANGER HAVING THE FIN

(71) Applicant: SANHUA (HANGZHOU) MICRO CHANNEL HEAT EXCHANGER CO., LTD., Hangzhou (CN)

(72) Inventors: Chao Liu, Hangzhou (CN); Yan He, Hangzhou (CN); Zhiming Dong, Hangzhou (CN); Huilai Fu, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 55 days.

(21) Appl. No.: 15/304,170

(22) PCT Filed: Jan. 22, 2015

(86) PCT No.: PCT/CN2015/071355
§ 371 (c)(1),
(2) Date: Oct. 14, 2016

(87) PCT Pub. No.: WO2015/158176
PCT Pub. Date: Oct. 22, 2015

(65) Prior Publication Data

US 2017/0030658 A1 Feb. 2, 2017

(30) Foreign Application Priority Data

Apr. 16, 2014 (CN) ..... 2014 1 0154301
Apr. 16, 2014 (CN) ..... 2014 2 0186276 U

(51) Int. Cl.
*F28F 1/12* (2006.01)
*F28D 1/053* (2006.01)
(Continued)

(52) U.S. Cl.
CPC ..... *F28F 1/128* (2013.01); *F28D 1/053* (2013.01); *F28D 1/05383* (2013.01); *F28F 1/12* (2013.01);
(Continued)

(58) Field of Classification Search
CPC ..... F28D 1/05383; F28D 2001/0273; F28F 1/126; F28F 1/128; F28F 1/22; F28F 1/24;
(Continued)

(56) References Cited

U.S. PATENT DOCUMENTS 6,354,368 B1 3/2002 Nishishita et al.
7,147,047 B2 * 12/2006 Wolk ..... F28D 1/05383 165/152
(Continued)

FOREIGN PATENT DOCUMENTS

CN 101782337 A 7/2010
CN 202660817 U 1/2013
(Continued)

OTHER PUBLICATIONS

Machine Translation of JP-09101092, retrieved Jan. 31, 2018.*
(Continued)

*Primary Examiner* — Eric S Ruppert
*Assistant Examiner* — Hans R Weiland
(74) *Attorney, Agent, or Firm* — Howard & Howard Attorneys PLLC

(57) ABSTRACT

A fin and a bending type heat exchanger having the fin includes a first header pipe, a second header pipe, a flat pipe and the fin. The first header pipe and the second header pipe have bending sections. The fin extends generally in a wavy shape along a longitudinal direction and includes a main section and a connecting section, the main section and the connecting section are connected in series so as to make the
(Continued)

connecting section form a wave crest and a wave trough, and the fin is divided into a first end portion, a second end portion, and a central portion between the first end portion and the second end portion along a transverse direction, in which the connecting section of the central portion, forming the wave crest and the wave trough, is connected with the flat pipe, and a gap exists between the connecting section, forming the wave crest and/or the wave trough, of at least one of the first end portion and the second end portion and the flat pipe within the bending section.

8 Claims, 4 Drawing Sheets

(51) Int. Cl.
*F28F 1/22* (2006.01)
*F28D 1/02* (2006.01)

(52) U.S. Cl.
CPC ..... *F28F 1/22* (2013.01); *F28D 2001/0273* (2013.01); *F28F 2255/02* (2013.01); *F28F 2260/02* (2013.01)

(58) Field of Classification Search
CPC ..... F28F 1/30; F28F 1/32; F28F 1/325; F28F 2215/00; F28F 2215/10; F28F 2215/14; F28F 2255/02
See application file for complete search history.

(56) References Cited

U.S. PATENT DOCUMENTS

| | | | | |
|---|---|---|---|---|
| 7,699,095 | B2 * | 4/2010 | Beamer | F28D 1/05366 165/151 |
| 2005/0077033 | A1 * | 4/2005 | Schmalzried | F02B 29/0462 165/152 |
| 2007/0251681 | A1 * | 11/2007 | Higashiyama | F28F 1/128 165/153 |
| 2010/0181058 | A1 | 7/2010 | Huazhao et al. | |
| 2011/0036550 | A1 * | 2/2011 | Jiang | F28F 1/128 165/173 |
| 2012/0227945 | A1 * | 9/2012 | Taras | F28F 1/128 165/172 |
| 2013/0068438 | A1 * | 3/2013 | Matsumoto | F28D 1/05333 165/183 |
| 2016/0216047 | A1 | 7/2016 | He et al. | |

FOREIGN PATENT DOCUMENTS

| | | | | | |
|---|---|---|---|---|---|
| CN | 103411446 | A | | 11/2013 | |
| CN | 103913088 | A | | 7/2014 | |
| CN | 104236332 | A | | 12/2014 | |
| CN | 204043463 | U | | 12/2014 | |
| EP | 0962736 | A2 | | 12/1999 | |
| EP | 2233874 | A1 | | 9/2010 | |
| FR | 2860289 | A1 | | 4/2005 | |
| FR | 2875896 | A1 | | 3/2006 | |
| JP | S52072632 | A | | 6/1977 | |
| JP | S57113132 | U | | 7/1982 | |
| JP | S5918179 | U | | 2/1984 | |
| JP | S61198886 | U | | 12/1986 | |
| JP | 09101092 | A | * | 4/1997 | F28F 1/325 |
| JP | H111142079 | A | | 5/1999 | |
| JP | 2000028228 | A | | 1/2000 | |
| JP | 2002130973 | A | | 5/2002 | |
| JP | 2002195774 | A | | 7/2002 | |
| JP | 2002243381 | A | | 8/2002 | |
| JP | 2003322486 | A | | 11/2003 | |
| JP | 2005090806 | A | | 4/2005 | |
| JP | 2005331176 | A | | 12/2005 | |
| JP | 2006105415 | A | | 4/2006 | |
| JP | 2008292083 | A | | 12/2008 | |
| JP | 2009115339 | A | | 5/2009 | |
| JP | 2013139971 | A | | 7/2013 | |
| WO | 2013186800 | A1 | | 12/2013 | |

OTHER PUBLICATIONS

Machine Translaiton of FR 2875896, Retrived Apr. 26, 2019 (Year: 2019).*

Inntemational Search Report of the International Searching Authority for PCT Application No. PCT/CN2015/071355 dated Apr. 22, 2015.

Notification of Reasons for Refusal dated Oct. 23, 2017 for Japanese Application No. 2016-563067.

Communication dated Nov. 7, 2017 transmitting the Extended European Search Report dated Oct. 26, 2017 for European Application No. 15779653.3.

Notification of Reason for Refusal for Korean Application No. 10-2016-7031333 dated Jan. 5, 2018.

Notification of Reason for Refusal for Korean Application No. 10-2016-7031333 dated Sep. 20, 2018.

Notice of Reasons for Refusal for Japanese Patent Application No. 2018-193007 dated Sep. 2, 2019.

* cited by examiner

FIN AND BENDING TYPE HEAT EXCHANGER HAVING THE FIN

CROSS-REFERENCE TO RELATED APPLICATIONS

The present application is a National Stage of International Patent Application No. PCT/CN2015/071355, filed on Jan. 22, 2015, which claims priority to and all the benefits of Chinese Patent Application Serial No. 201410154301.X filed with the State Intellectual Property Office of P. R. China on Apr. 16, 2014 and Chinese Patent Application Serial No. 201420186276.9 filed with the State Intellectual Property Office of P. R. China on Apr. 16, 2014, the entire contents of which are incorporated herein by reference.

BACKGROUND OF THE INVENTION

1. Field of the Invention

The present disclosure relates to a field of heat exchanger technology, specifically, to a fin and a bending type heat exchanger having the fin.

2. Description of the Related Art

In the related art, for example, a parallel flow heat exchanger as a micro-channel heat exchanger usually needs to be bent along a length direction of a header pipe, in order to adapt to use in different spaces. However, in a bending process of the heat exchanger, a fin inside a bend will be squeezed and fin's deflection and distortion will occur to block air circulation. In addition, a fin outside the bend, which has been weld with a flat pipe, will be stretched and easy to detach from the flat pipe or be torn, thus influencing an appearance quality and heat transfer performance of the heat exchanger.

SUMMARY OF THE INVENTION

The present disclosure aims to solve one of the technical problems in the related art at least to some extent. Thus, one objective of the present disclosure is to provide a bending type heat exchanger, which can prevent a fin from being squeezed or torn or reduce that in a bending process and have improved appearance quality and heat transfer performance.

Another objective of the present disclosure is to provide a fin.

The bending type heat exchanger according to embodiments of the present disclosure includes: a first header pipe and a second header pipe spaced apart from each other and having bending sections in one-to-one correspondence; a flat pipe having two ends connected with the first header pipe and the second header pipe respectively; and a fin disposed between adjacent flat pipes and having a width smaller than or equal to a width of the flat pipe in a transverse direction, in which the fin extends generally in a wavy shape along a longitudinal direction and comprises a main section and a connecting section, the main section and the connecting section are connected in series so as to make the connecting section form a wave crest and a wave trough, and the fin is divided into a first end portion, a second end portion, and a central portion between the first end portion and the second end portion along the transverse direction. The connecting section of the central portion, forming the wave crest and the wave trough, is connected with the flat pipe, and a gap exists between the connecting section, forming the wave crest and/or the wave trough, of at least one of the first end portion and the second end portion and the flat pipe within the bending section.

With the bending type heat exchanger according to embodiments of the present disclosure, as the gap exists between the connecting section, forming the wave crest and/or the wave trough, of one of the first end portion and the second end portion of the fin and the flat pipe, portions of the fin located inside and/or outside the bend are not influenced by the bending, which prevents the fin from being squeezed and/or deflected and distorted, solves difficulty of positioning the fin 4, the bending section of which has a smaller width than the flat pipe 3, due to additional installation and removal of positioning accessories for assembling different fins during the assembling process before welding the heat exchanger, and addresses the problem of poor position consistency of the fins at the bending section after welding. Thus, the bending type heat exchanger may prevent the fin from being squeezed or torn, or reduce that in the bending process and have better appearance quality as well as an improved heat transfer performance.

According to some embodiments of the present disclosure, the connecting section, forming the wave crest, of at least one end portion is removed or recessed towards the main section of the at least one end portion within the bending section.

According to some other embodiments of the present disclosure, within the bending section, the connecting section, forming the wave crest, of at least one end portion is cut off through a longitudinal kerf from the connecting section, forming the wave crest, of the central portion, and is divided into a first connecting portion and a second connecting portion through a transverse kerf, and the first connecting portion and the second connecting portion are bent relative to the main section of the at least one end portion.

In some further embodiments of the present disclosure, the connecting section, forming the wave trough, of at least one end portion is removed or recessed towards the main section of the at least one end portion within the bending section.

In some other further embodiments of the present disclosure, within the bending section, the connecting section, forming the wave trough, of at least one end portion is cut off through a longitudinal kerf from the connecting section, forming the wave trough, of the central portion, and is divided into a first connecting portion and a second connecting portion through a transverse kerf, and the first connecting portion and the second connecting portion are bent relative to the main section of the at least one end portion.

In some preferred embodiments of the present disclosure, a gap exists between the first end portion of the fin and the flat pipe both at a wave crest side and a wave trough side within the bending section.

In some preferred embodiments of the present disclosure, a gap exists between the second end portion of the fin and the flat pipe both at a wave crest side and a wave trough side within the bending section.

The fin according to embodiments of the present disclosure extends generally in a wavy shape along a longitudinal direction and comprises a main section and a connecting section, in which the main section and the connecting section are connected in series so as to make the connecting section form a wave crest and a wave trough, and the fin is divided into a first end portion, a second end portion, and a central portion between the first end portion and the second end portion along a transverse direction, in which a notch is formed in at least one of the first end portion and the second end portion of the fin at a wave crest side and/or a wave trough side within the bending section.

Specifically, the notch is formed by one of the following methods: within the bending section, the connecting section, forming the wave crest and/or the wave trough, of at least one end portion is removed or recessed towards the main section of the at least one end portion, or is cut off through a longitudinal kerf from the connecting section, forming the wave crest and/or the wave trough, of the central portion and divided into a first connecting portion and a second connecting portion through a transverse kerf, and the first connecting portion and the second connecting portion are bent relative to the main section of the at least one end portion.

Preferably, the notch is formed in the first end portion of the fin both at the wave crest side and the wave trough side as well as in the second end portion of the fin both at the wave crest side and the wave trough side within the bending section.

Other objects, features and advantages of the present invention will be readily appreciated as the same becomes better understood after reading the subsequent description taken in connection with the accompanying drawings.

Figure 1:
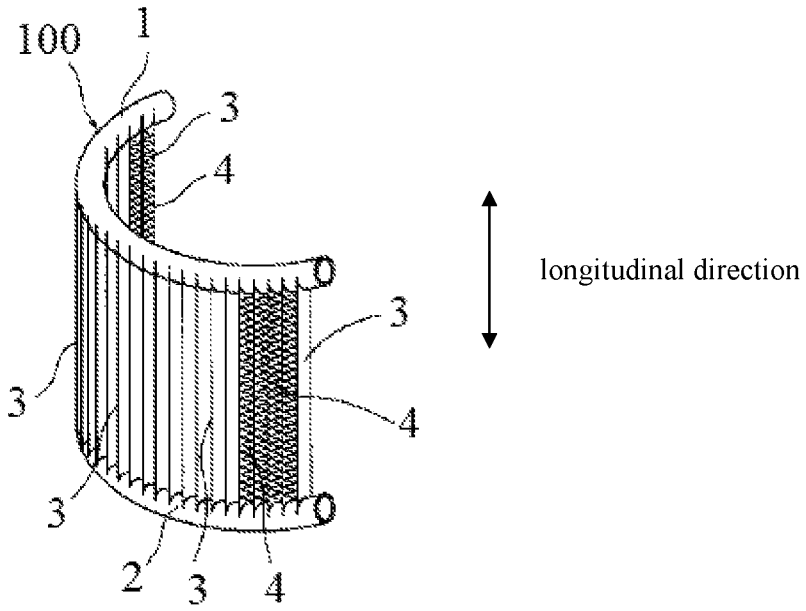
FIG. 1 is a schematic view of a bending type heat exchanger according to an embodiment of the present disclosure.

The following is a list of certain components of the present invention, along with their associated reference numerals:

bending type heat exchanger 100;
first header pipe 1; second header pipe 2; flat pipe 3;
fin 4;
main section 40; connecting section 41; gap 4A,
gap 4B, gap 4C, gap 4D;
first end portion 410;
second end portion 411;
central portion 412;
longitudinal kerf 43;
transverse kerf 42;
connecting section 4100 of first end portion;
first connecting portion 4101 of first end portion;
second connecting portion 4102 of first end portion;
connecting section 4110 of second end portion;
first connecting portion 4111 of second end portion;
second connecting portion 4112 of second end portion; and
connecting section 4120 of central portion.

DETAILED DESCRIPTION OF THE INVENTION

Embodiments of the present disclosure will be described in detail in the following and examples of the embodiments are shown in the drawings. The same or similar elements and the elements having same or similar functions are denoted by like reference numerals throughout the descriptions. The embodiments described herein with reference to the drawings are explanatory, used to generally understand the present disclosure and shall not be construed to limit the present disclosure.

A bending type heat exchanger 100 according to embodiments of the present disclosure will be described with reference to FIG. 1 to FIG. 9 in the following.

Figure 2:
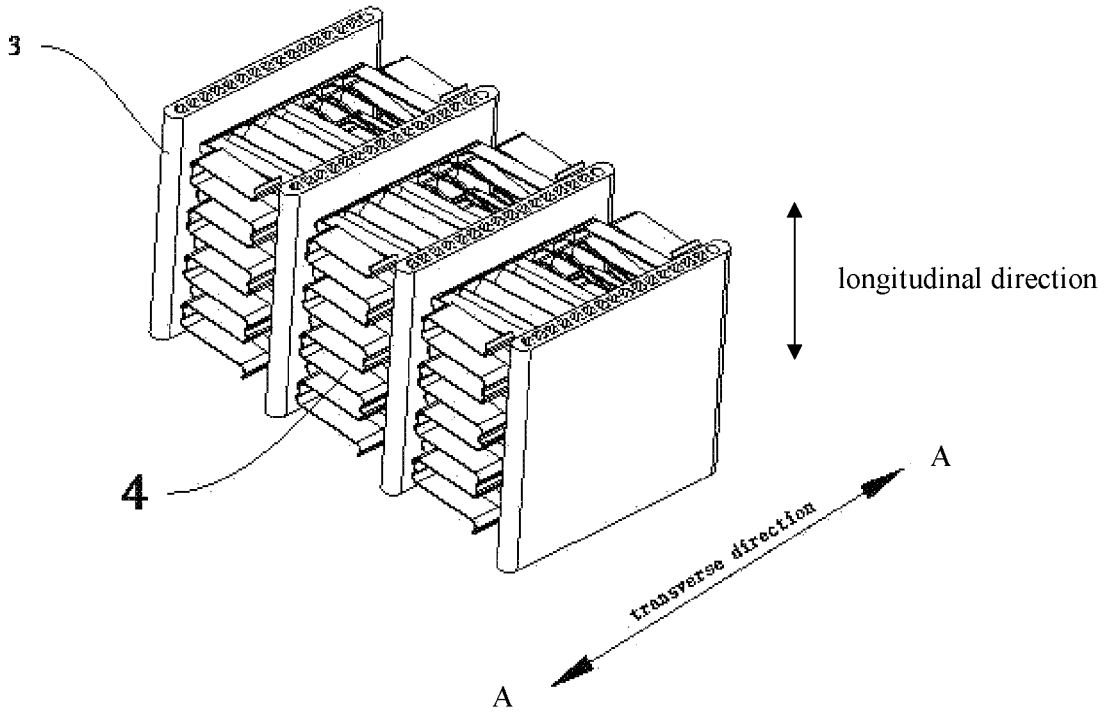
FIG. 2 is a schematic view of part of assembled flat pipes and fins of a bending type heat exchanger according to an embodiment of the present disclosure.
Figure 3:
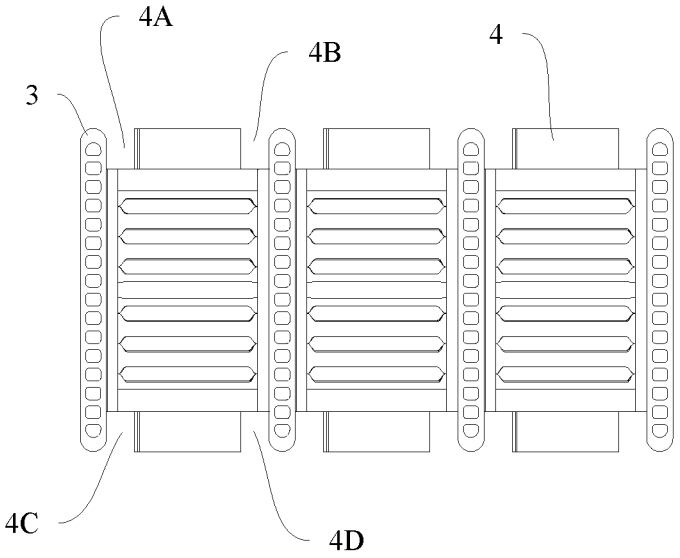
FIG. 3 is another schematic view of part of assembled flat pipes and fins of a bending type heat exchanger according to an embodiment of the present disclosure.

As shown in FIG. 1 to FIG. 3, the bending type heat exchanger 100 according to embodiments of the present disclosure includes: a first header pipe 1, a second header pipe 2, a flat pipe 3 and a fin 4. The first header pipe 1 and the second header pipe 2 are spaced apart from each other; as shown in FIG. 1, the first header pipe 1 and the second header pipe 2 are spaced apart from each other in a longitudinal direction and have bending sections in one-to-one correspondence.

The flat pipe 3 has two ends connected with the first header pipe 1 and the second header pipe 2 respectively. Specifically, a plurality of flat pipes 3 are spaced apart from each other along a length direction of the first header pipe 1 and the second header pipe 2, and each flat pipe 3 is in communication with the first header pipe 1 and the second header pipe 2 respectively. When the first header pipe 1 and the second header pipe 2 are bent, space among the plurality of flat pipes 3 connected with the bending sections of the first header pipe 1 and the second header pipe 2 changes. Specifically, the space between the adjacent flat pipes 3 which are located inside the bend decreases, and the space between the adjacent flat pipes 3 which are located outside the bend increases. It should be understood that, "the bending section" should be interpreted broadly, and as long as the space between the adjacent flat pipes 3 changes, portions of the first header pipe 1 and the second header pipe 2 connected to the flat pipes 3 with changed space therebetween could be called "the bending section". In other words, a curved section of the first header pipe 1 and the second header pipe 2 and an area influenced by the curved section are called "the bending section".

The fin 4 is disposed between adjacent flat pipes 3 and has a width smaller than or equal to a width of the flat pipe 3 in a transverse direction; the fin 4 extends generally in a wavy shape along a longitudinal direction and includes a main section 40 and a connecting section 41, and the main section 40 and the connecting section 41 are connected in series so as to make the connecting section 41 form a wave crest and a wave trough. That is, one waveform of the fin 4 includes the main section 40 and the connecting section 41, and the connecting section 41 forms the wave crest and the wave trough of the waveform. Each fin 4 is connected with the two corresponding flat pipes 3 through the connecting section 41.

The fin 4 is divided into a first end portion 410, a second end portion 411, and a central portion 412 between the first end portion 410 and the second end portion 411 along the transverse direction (as shown with arrow A in FIG. 2). The connecting section 41 of the central portion 412, which forms the wave crest and the wave trough, is connected with the flat pipe 3, and within the bending section, a gap exists between the connecting section 41, forming the wave crest and/or the wave trough, of at least one of the first end portion 410 and the second end portion 411 and the flat pipe 3. Specifically, the gap may exist between a connecting section 4100 of the first end portion 410 and the flat pipe 3, or between a connecting section 4110 of the second end portion 411 and the flat pipe 3, or both between the connecting section 4100 and the flat pipe 3 and between the connecting section 4110 and the flat pipe 3, in which the connecting section 41 having the gap with the flat pipe 3 may be the connecting section 41 forming the wave crest and/or the wave trough. In other words, a notch is formed in at least one of the first end portion 410 and the second end portion 411 of the fin 4 at a wave crest side and/or a wave trough side, and the notch forms the gap between the connecting section 41 and the flat pipe 3.

It should be illustrated that, "the presence of the gap" means that connecting section 41, forming the wave crest and/or the wave trough, of at least one of the first end portion 410 and the second end portion 411 is not connected with the flat pipe 3, and meanwhile as the width of the fin 4 is usually smaller than or equal to the width of the flat pipe 3, the first end portion 410 and the second end portion 411 don't extend beyond the flat pipe 3 in the transverse direction. Thus, when the first header pipe 1 and the second header pipe 2 are bent, portions of the fin 4 located inside and/or outside the bend are not influenced. For example, the fin 4 inside the bend may not be squeezed, and the fin 4 outside the bend may not be stretched to detach from the flat pipe 3 or be torn, therefore preventing the fin 4 from being squeezed and/or deflected and distorted.

Meanwhile, it should be illustrated that, the connecting section 41, forming the wave crest and/or the wave trough, of the first end portion 410 and/or the second end portion 411 of the fin 4 may be formed to be any shapes, as long as the connecting section 41 is not connected with the flat pipe 3.

With the bending type heat exchanger 100 according to embodiments of the present disclosure, as the gap exists between the connecting section 41, forming the wave crest and/or the wave trough, of one of the first end portion 410 and the second end portion 411 of the fin 4 and the flat pipe 3, portions of the fin 4 located inside and/or outside the bend are not influenced by the bending, which prevents the fin 4 from being squeezed and/or deflected and distorted, solves difficulty of positioning the fin 4, the bending section of which has a smaller width than the flat pipe 3, due to additional installation and removal of positioning accessories for assembling different fins 4 during the assembling process before welding the heat exchanger 100, and addresses the problem of poor position consistency of the fins 4 at the bending section after welding. Thus, the bending type heat exchanger 100 may prevent the fin 4 from being squeezed or torn, or reduce that in the bending process and have better appearance quality as well as improved heat transfer performance.

A specific structure of the bending type heat exchanger 100 and the fin 4 according to a specific embodiment of the present disclosure will be described referring to FIG. 1 to FIG. 7.

As shown in FIG. 1, the bending type heat exchanger 100 includes the first header pipe 1, the second header pipe 2, the flat pipe 3 and the fin 4. The first header pipe 1 is disposed above the second header pipe 2, and the first header pipe 1 and the second header pipe 2 are in a bent state, i.e. the first header pipe 1 and the second header pipe 2 have bending sections respectively.

As shown in FIG. 1, the plurality of the flat pipes 3 are spaced apart along the length direction of the first header pipe 1, and each flat pipe 3 is in communication with the first header pipe 1 and the second header pipe 2 to circulate a refrigerant. Meanwhile the fin 4 is connected between every two flat pipes 3 and extends sinuously in the longitudinal direction, and each fin 4 has a width smaller than or equal to a width of the flat pipe 3 in the transverse direction, i.e. the first end portion 410 and the second end portion 411 don't extend beyond the flat pipe 3.

Each fin 4 extends generally in the wavy shape along the longitudinal direction and includes the main section 40 and the connecting section 41, and the main section 40 and the connecting section 41 are connected in series so as to make the connecting section 41 form the wave crest and the wave trough. That is, one waveform of the fin 4 includes the main section 40 and the connecting section 41, and the connecting section 41 forms the wave crest and the wave trough of the waveform. Each fin 4 is connected with the two corresponding flat pipes 3 through the connecting section 41.

The fin 4 is divided into the first end portion 410, the second end portion 411, and the central portion 412 between the first end portion 410 and the second end portion 411 along the transverse direction (as shown with the arrow A in FIG. 2). The connecting section 41 of the central portion 412, which forms the wave crest and the wave trough, is connected with the flat pipe 3.

As shown in FIG. 1 to FIG. 4, a gap 4C exists between the first end portion 410 and the flat pipe 3 at the wave crest side, a gap 4D exists between the first end portion 410 and the flat pipe 3 at the wave trough side, a gap 4A exists between the second end portion 411 and the flat pipe 3 at the wave crest side, and a gap 4B exists between the second end portion 411 and the flat pipe 3 at the wave trough side. In other words, the notches are formed in the first end portion 410 at the wave crest side, formed in the first end portion 410 at the wave trough side, formed in the second end portion 411 at the wave crest side, and formed in the second end portion 410 at the wave trough side respectively.

In the bending process of the bending type heat exchanger 100, the fin 4 inside the bend is not connected with the flat pipe 3, so the fin 4 inside the bend will not be squeezed. Meanwhile, the fin 4 outside the bend is not connected with the flat pipe 3, so the fin 4 outside the bend will not be stretched to detach from the flat pipe 3, thereby preventing the fin 4 from being deflected or distorted, guaranteeing the air circulation between the fins 4 to ensure the heat transfer performance of the bending type heat exchanger 100, and meanwhile guaranteeing the appearance quality of the bending type heat exchanger 100.

Figure 5:
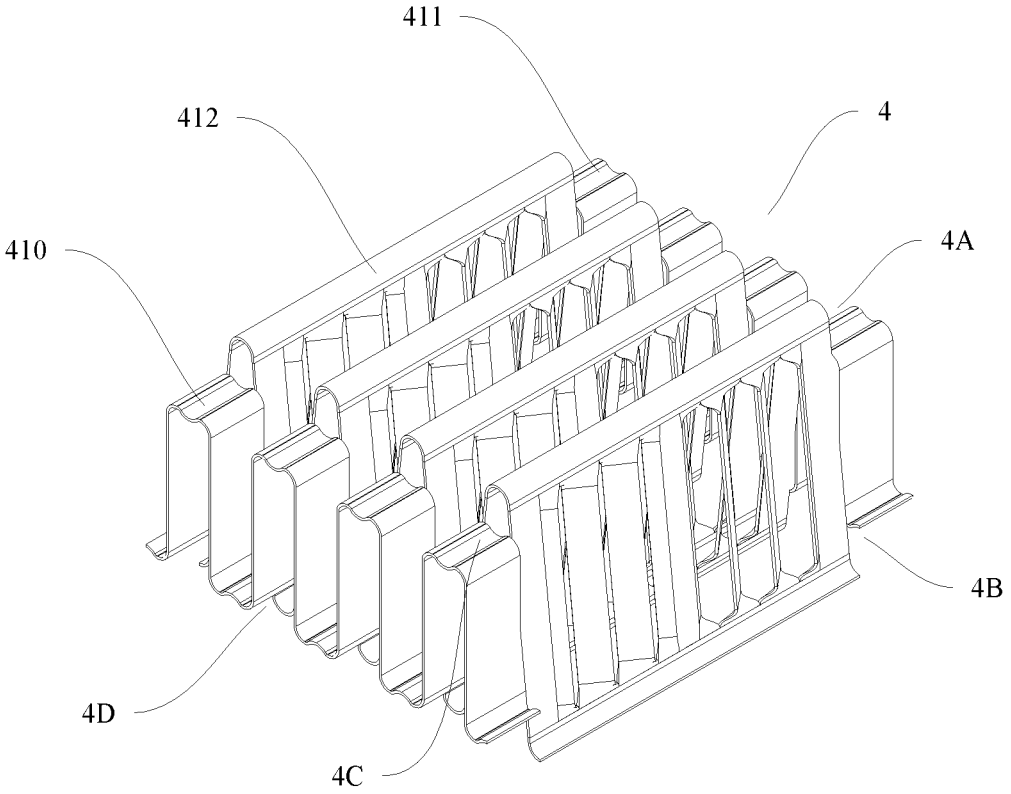
FIG. 5 is a perspective view of a fin according to embodiments of the present disclosure.

As shown in FIG. 2 and FIG. 5, within the bending section, the connecting section 41, forming the wave crest, of the first end portion 410 of the fin 4, is recessed towards the main section 40 of the first end portion 410; the connecting section 41, forming the wave trough, of the first end portion 410 of the fin 4, is recessed towards the main section 40 of the first end portion 410; the connecting section 41, forming the wave crest, of the second end portion 411 of the fin 4, is recessed towards the main section 40 of the second end portion 410; the connecting section 41, forming the wave trough, of the second end portion 410 of the fin 4, is recessed towards the main section 40 of the second end portion 410. A surface, facing towards the flat pipe 3, of the notch formed in a recessing manner may be a flat surface or a curved surface. When the surface of the notch facing towards the flat pipe 3 is the curved surface, it is not only favourable for increasing flow disturbance, but also for condensate discharge.

Figure 6:
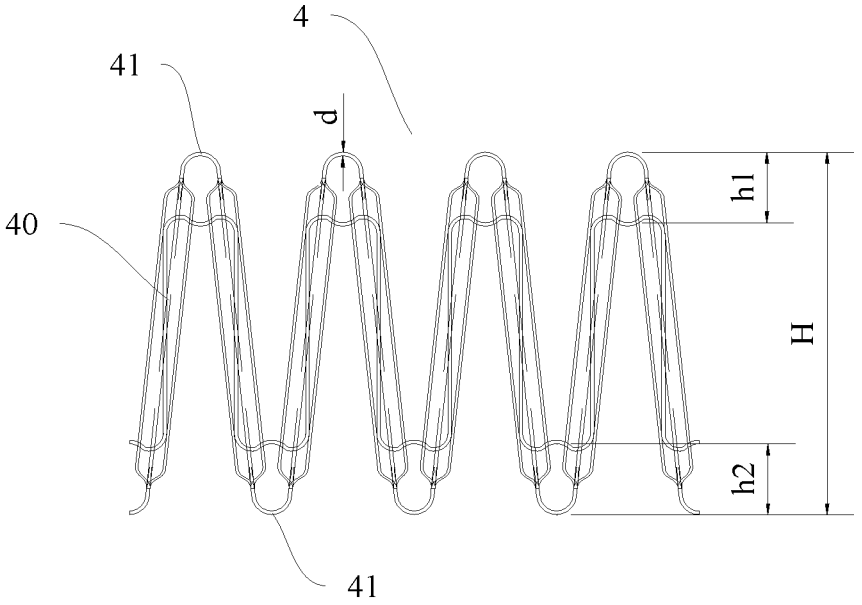
FIG. 6 is a side view of a fin according to embodiments of the present disclosure.
Figure 7:
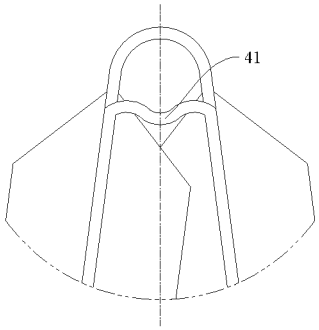
FIG. 7 is a partially enlarged view of a fin according to an embodiment of the present disclosure.

For convenience of recessing the connecting section 41 to form the notch, as shown in FIG. 6 and FIG. 7, the connecting section 41, forming the wave crest, of the first end portion 410 of the fin 4 may be first cut off from the connecting section 41, forming the wave crest, of the central portion 412 through a kerf, and then recessed towards the main section 40 of the first end portion 410; the connecting section 41, forming the wave trough, of the first end portion 410 of the fin 4 may be first cut off from the connecting section 41, forming the wave trough, of the central portion 412 through a kerf, and then recessed towards the main section 40 of the first end portion 410; the connecting section 41, forming the wave crest, of the second end portion 411 of the fin 4 may be first cut off from the connecting section 41, forming the wave crest, of the central portion 412 through a kerf, and then recessed towards the main section 40 of the second end portion 411; the connecting section 41, forming the wave crest, of the second end portion 411 of the fin 4 may be first cut off from the connecting section 41, forming the wave trough, of the central portion 412 through a kerf, and then recessed towards the main section 40 of the second end portion 411 then.

Specifically, a side shape of the recess (i.e. the side shape of the notch) may be a sinusoidal waveform, a triangular waveform, a rectangle waveform or a trapezoidal waveform.

A specific structure of the fin 4 according to another specific embodiment of the present disclosure will be described referring to FIG. 8 and FIG. 9.

The fin 4 according to this embodiment of the present disclosure differs from the fin 4 in the above embodiment in that: the machining methods for the notch of the fin 4 are different. Other portions of the fin 4 have the same shape as the fin 4 of the central portion 412. The machining method of the notch of the first end portion 410 and the second end portion 411 at the wave crest side of the fin 4 in one waveform is taken as an example for illustration.

Figure 8:
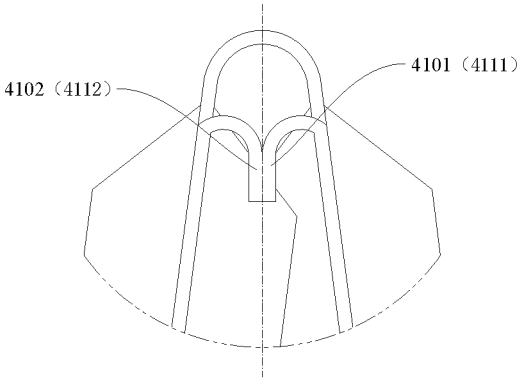
FIG. 8 is a partially enlarged view of a fin according to another embodiment of the present disclosure.
Figure 9:
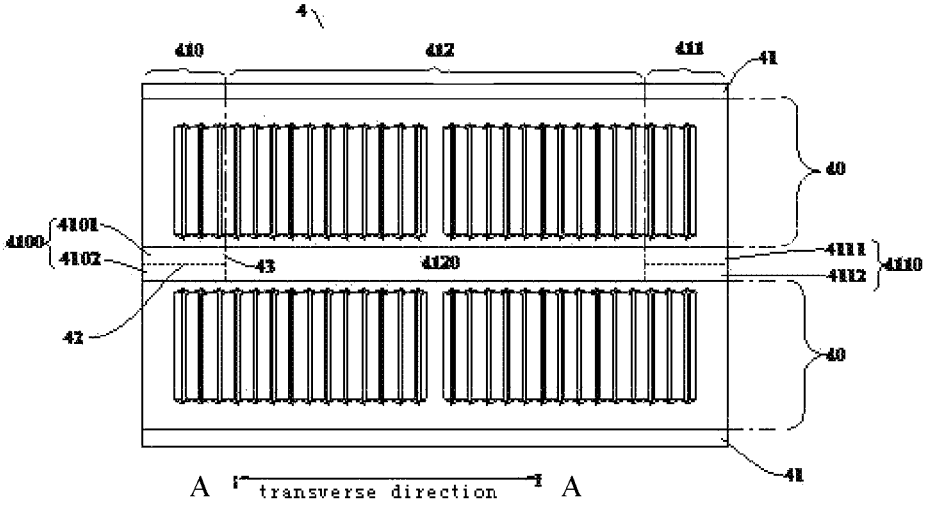
FIG. 9 is an unfolded view of a fin in one waveform according to embodiments of the present disclosure.

As shown in FIG. 8 and FIG. 9, the connecting section 4100, forming the wave crest, of the first end portion 410 of the fin 4 is cut off through a longitudinal kerf 43 from the connecting section 4120, forming the wave crest, of the central portion 412, and is divided into a first connecting portion 4101 and a second connecting portion 4102 through a transverse kerf 42; and the first connecting portion 4101 and the second connecting portion 4102 are bent relative to the main section 40 of the first end portion 410. In other words, the notch is formed by the longitudinal kerf, the transverse kerf, and the bending method successively. Preferably, the first connecting portion 4101 and the second connecting portion 4102 of the connecting section 4100, forming the wave crest, of the first end portion 410 have the same area.

The connecting section 4110, forming the wave crest, of the second end portion 411 of the fin 4 is cut off through the longitudinal kerf 43 from the connecting section 4120, forming the wave crest, of the central portion 412, and is divided into the first connecting portion 4111 and a second connecting portion 4112 through the transverse kerf 42; and the first connecting portion 4111 and the second connecting portion 4112 are bent relative to the main section 40 of the second end portion 411. Preferably, the first connecting portion 4111 and the second connecting portion 4112 of the connecting section 4110, forming the wave crest, of the second end portion 411 have the same area.

It could be understood that, the notches of the first end portion 410 and/or the second end portion 411 of the fin 4 at the wave trough side may also adopt the above method, which will not be described in detail here.

In the embodiments of the present disclosure, the notch is formed by the longitudinal kerf, the transverse kerf, and the bending process successively, such that the fin 4 may have better supporting strength in the longitudinal direction, and it is favourable for increasing flow disturbance, promoting heat transfer, and discharging the condensate.

It should be illustrated that, the methods for forming the notch of the fin 4 according to embodiments of the present disclosure are not limited to the two methods above, and may further include other methods, such as removing the connecting section 41, forming the wave crest and/or the wave trough, of as least one end portion to form the notch.

Thus, in summary, according to embodiments of the present disclosure, the formation positions and methods of the notches in the fin 4 may include the following conditions: in some embodiments of the present disclosure, the connecting section 41, forming the wave crest, of at least one end portion is removed or recessed towards the main section 40 of the at least one end portion within the bending section; and/or the connecting section 41, forming the wave trough, of at least one end portion is removed or recessed towards the main section 40 of the at least one end portion within the bending section.

In some other embodiments of the present disclosure, within the bending section, the connecting section 41, forming the wave crest, of at least one end portion is cut off through the longitudinal kerf from the connecting section 41, forming the wave crest, of the central portion 412, and is divided into the first connecting portion and the second connecting portion through the transverse kerf, and the first connecting portion and the second connecting portion are bent relative to the main section 40 of the at least one end portion; and/or within the bending section, the connecting section 41, forming the wave trough, of at least one end portion is cut off through the longitudinal kerf from the connecting section 41, forming the wave trough, of the central portion 412, and is divided into the first connecting portion and the second connecting portion through the transverse kerf, and the first connecting portion and the second connecting portion are bent relative to the main section 40 of the at least one end portion.

It could be understood that, when the notches are formed in the first end portion 410 of the fin 4 both at the wave crest side and the wave trough side, and formed in the second end portion 411 of the fin 4 both at the wave crest side and the wave trough side, the formation methods of the four notches may be identical or different.

Figure 4:
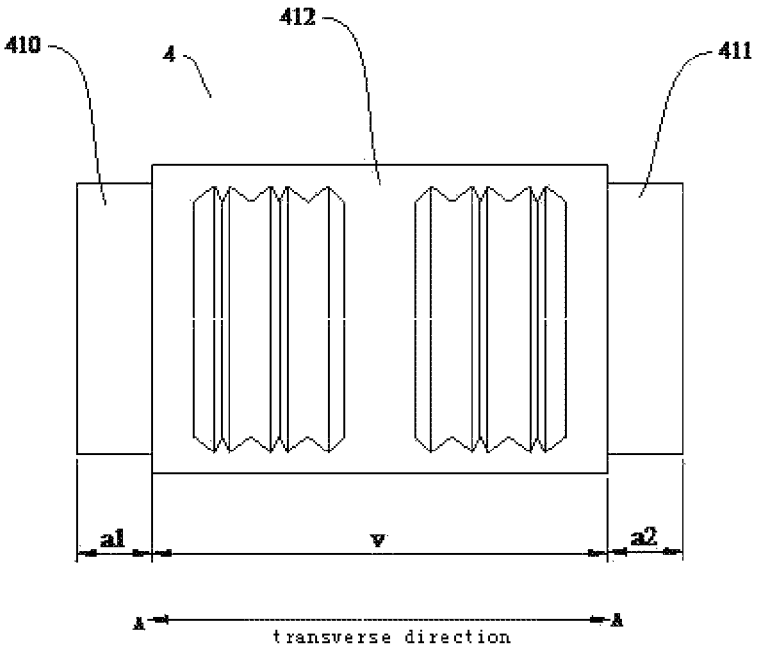
FIG. 4 is an unfolded view of a fin according to embodiments of the present disclosure.

According to some specific embodiments of the present disclosure, as shown in FIG. 4 and FIG. 6, a relationship among a width a1 of the first end portion 410, a width a2 of the second end portion 411, and a width V of the central portion 412 satisfies: $0 \le a1 \le 1.5V$, $0 \le a2 \le 1.5V$. A relationship among a material thickness d of the fin 4, a height H of the fin 4, a height h1 of the notch at the wave crest side and a height h2 of the notch at the wave trough side satisfies: $d \le h1 \le 0.35H$, $d \le h2 \le 0.35H$. The inventor of the present application has found that the fin can be prevented from being squeezed and/or torn in the bending process better with the above dimensions relationships.

In the specification, it is to be understood that terms such as "central," "longitudinal," "transverse," "length," "width," "thickness," "upper," "lower," "front," "rear," "left," "right," "vertical," "horizontal," "top," "bottom," "inner,"

"outer," "an axial direction," "a radical direction," and "a circumferential direction," should be construed to refer to the orientation as then described or as shown in the drawings under discussion. These relative terms are for convenience of description, do not require that the present disclosure be constructed or operated in a particular orientation, and shouldn't be construed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections or be communicated with each other; may also be direct connections or indirect connections via intervening structures; may also be inner communications or interaction of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an intervening structures. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment,", "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. Furthermore, different embodiments or examples in thus specification can be jointed and combined by those skilled in the art without mutual contradiction.

Although embodiments have been shown and described, it would be appreciated that the embodiments above are explanatory and cannot be construed to limit the present disclosure, and changes, modifications alternatives and transformation to the embodiments above can be made by those skilled in the art in the scope of the present disclosure.

What is claimed is:

1. A bending type heat exchanger, comprising:

a first header pipe and a second header pipe spaced apart from each other and having bending sections in one-to-one correspondence;

a plurality of flat pipes, each of the plurality of flat pipes having two ends connected with the first header pipe and the second header pipe respectively; and a fin disposed between adjacent flat pipes and having a width smaller than or equal to a width of the flat pipes in a transverse direction, wherein the fin extends generally in a wavy shape along a longitudinal direction and comprises a main section and a connecting section, the main section and the connecting section are connected in series so as to make the connecting section form a wave crest and a wave trough, and the fin is divided into a first end portion, a second end portion, and a central portion between the first end portion and the second end portion along the transverse direction;

wherein the connecting section of the central portion is connected with the flat pipes, and a gap exists between the connecting section of at least one of the first end portion and the second end portion and the flat pipes within the bending sections;

wherein the connecting section of at least one of the first end portion and the second end portion and the connecting section of the central portion are cut apart each other through a longitudinal kerf, the connecting section of at least one of the first end portion and the second end portion is cut open through a transverse kerf so that the connecting section of at least one of the first end portion and the second end portion is divided into a first connecting portion and a second connecting portion, and the first connecting portion and the second connecting portion are bent in a direction away from the flat pipes and towards the main section of at least one of the first end portion and the second end portion.

2. The bending type heat exchanger as set forth in claim 1, wherein a gap exists between the first end portion of the fin and the flat pipes both at a wave crest side and a wave trough side within the bending sections or between the second end portion of the fin and the flat pipes both at a wave crest side and a wave trough side within the bending sections.

3. The bending type heat exchanger as set forth in claim 1, wherein a relationship among a width a1 of the first end portion, a width a2 of the second end portion, and a width V of the central portion satisfies: $0 \le a1 \le 1.5V$, $0 \le a2 \le 1.5V$.

4. The bending type heat exchanger as set forth in claim 1, wherein a relationship among a material thickness d of the fin, a height H of the fin, a height h1 of a notch at a wave crest side and a height h2 of the notch at a wave trough side satisfies: $d \le h1 \le 0.35H$, $d \le h2 \le 0.35H$.

5. A fin, extending generally in a wavy shape along a longitudinal direction and comprising a main section and a connecting section, wherein the main section and the connecting section are connected in series so as to make the connecting section form a wave crest and a wave trough, and the fin is divided into a first end portion, a second end portion, and a central portion between the first end portion and the second end portion along a transverse direction, wherein:

a notch is formed in at least one of the first end portion and the second end portion of the fin at a wave crest side and/or a wave trough side, wherein the notch is formed by one of the following methods:

the connecting section of at least one of the first end portion and the second end portion and the connecting section of the central portion are cut apart from each other through a longitudinal kerf, the connecting section of at least one of the first end portion and the second end portion is cut open through a transverse kerf so that the connecting section of at least one of the first end portion and the second end portion is divided into a first connecting portion and a second connecting portion, and the first connecting portion and the second connecting portion are bent in a direction adjacent to the main section of the at least one of the first end portion and the second end portion;

wherein the transverse kerf extends in a whole length of the connecting section of at least one of the first end portion and the second end portion.

6. The fin as set forth in claim 5, wherein the notch is formed in the first end portion of the fin both at the wave crest side and the wave trough side as well as in the second end portion of the fin both at the wave crest side and the wave trough side.

7. The fin as set forth in claim 5, wherein a relationship among a width a1 of the first end portion, a width a2 of the second end portion, and a width V of the central portion satisfies: $0 \leq a1 \leq 1.5V$, $0 \leq a2 \leq 1.5V$.

8. The fin as set forth in claim 5, wherein a relationship among a material thickness d of the fin, a height H of the fin, a height h1 of the notch at a wave crest side and a height h2 of the notch at a wave trough side satisfies: $d \leq h1 \leq 0.35H$, $d \leq h2 \leq 0.35H$.

* * * * *